US011440158B2

(12) United States Patent
Scott et al.

(10) Patent No.: US 11,440,158 B2
(45) Date of Patent: Sep. 13, 2022

(54) COATED COMPRESSIVE SUBPAD FOR CHEMICAL MECHANICAL POLISHING

(71) Applicant: Cabot Microelectronics Corporation, Aurora, IL (US)

(72) Inventors: Diane Scott, Portland, OR (US); Paul Andre Lefevre, Portland, OR (US)

(73) Assignee: CMC Materials, Inc., Aurora, IL (US)

( * ) Notice: Subject to any disclaimer, the term of this patent is extended or adjusted under 35 U.S.C. 154(b) by 787 days.

(21) Appl. No.: 15/875,773

(22) Filed: Jan. 19, 2018

(65) Prior Publication Data

US 2018/0141183 A1 May 24, 2018

Related U.S. Application Data

(62) Division of application No. 14/635,973, filed on Mar. 2, 2015, now abandoned.

(60) Provisional application No. 62/083,101, filed on Nov. 21, 2014.

(51) Int. Cl.

| | |
|---|---|
| ***B24B 37/22*** | (2012.01) |
| ***B24B 37/24*** | (2012.01) |
| ***B24D 18/00*** | (2006.01) |

(52) U.S. Cl.

CPC ..... *B24B 37/22* (2013.01); *B24B 37/24* (2013.01); *B24D 18/0072* (2013.01)

(58) Field of Classification Search

CPC ..... B24B 37/22; B24B 37/24; B24D 18/0072
USPC ..... 451/530, 533, 538
See application file for complete search history.

(56) References Cited

U.S. PATENT DOCUMENTS

| | | | | |
|---|---|---|---|---|
| 7,132,033 | B2 * | 11/2006 | Boldizar | B24B 37/205 156/324 |
| 7,645,186 | B1 * | 1/2010 | Jensen | B24B 37/22 156/289 |
| 9,064,806 | B1 * | 6/2015 | Qian | H01L 21/304 |
| 9,259,820 | B2 * | 2/2016 | Qian | B24B 37/205 |
| 2005/0189065 | A1 * | 9/2005 | Boldizar | B24B 37/205 156/250 |
| 2008/0003923 | A1 * | 1/2008 | Benvegnu | B24B 37/205 451/6 |

(Continued)

FOREIGN PATENT DOCUMENTS

| | | |
|---|---|---|
| JP | 2005161490 A | 6/2005 |
| WO | 2009086557 A1 | 7/2009 |

OTHER PUBLICATIONS

Japanese Patent Office, Notice of Reasons for Rejection issued in connection with JP2017-527270 dated Aug. 20, 2019.

(Continued)

*Primary Examiner* — Eileen P Morgan
(74) *Attorney, Agent, or Firm* — Thomas Omholt; Erika R. Singleton

(57) ABSTRACT

Coated compressive subpads for polishing pad stacks and methods of fabricating coated compressive subpads for polishing pad stacks are described. In an example, a polishing pad stack for polishing a substrate includes a polishing pad having a polishing surface and a back surface. The polishing pad stack also includes a compressive subpad with a first surface having a first pressure sensitive adhesive layer coated thereon. The first surface of the compressive subpad is coupled directly to the back surface of the polishing pad by the first pressure sensitive adhesive layer.

10 Claims, 10 Drawing Sheets

(56) References Cited

U.S. PATENT DOCUMENTS

| | | | | |
|---|---|---|---|---|
| 2008/0153253 | A1* | 6/2008 | Yoon | B24B 37/044 438/424 |
| 2010/0012269 | A1* | 1/2010 | Jensen | B24B 37/22 156/289 |
| 2010/0015902 | A1 | 1/2010 | Jensen et al. | |
| 2010/0190004 | A1* | 7/2010 | Gibbins | A61F 13/02 428/346 |
| 2011/0130077 | A1* | 6/2011 | Litke | B24B 37/24 451/41 |
| 2011/0171883 | A1* | 7/2011 | Allison | B24B 37/205 451/6 |
| 2014/0357163 | A1* | 12/2014 | Murnane | B24B 37/22 451/56 |
| 2015/0273652 | A1* | 10/2015 | Qian | B24B 37/205 438/692 |

OTHER PUBLICATIONS

The China Intellectual Property Administration, Third Office Action issued in connection with Application No. 201580063415.6 dated Nov. 26, 2019.

* cited by examiner

300B

300A

COATED COMPRESSIVE SUBPAD FOR CHEMICAL MECHANICAL POLISHING

CROSS-REFERENCE TO RELATED APPLICATIONS

This application is a divisional of co-pending application Ser. No. 14/635,973, filed on Mar. 2, 2015, which claims the benefit of U.S. Provisional Application No. 62/083,101, filed on Nov. 21, 2014, the entire contents of which are hereby incorporated by reference herein.

TECHNICAL FIELD

Embodiments of the present invention are in the field of chemical mechanical polishing (CMP) and, in particular, coated compressive subpads for polishing pad stacks and methods of fabricating coated compressive subpads for polishing pad stacks.

BACKGROUND

Chemical-mechanical planarization or chemical-mechanical polishing, commonly abbreviated CMP, is a technique used in semiconductor fabrication for planarizing a semiconductor wafer or other substrate.

The process uses an abrasive and/or corrosive chemical slurry (commonly a colloid) in conjunction with a polishing pad and retaining ring, typically of a greater diameter than the wafer. The polishing pad and wafer are pressed together by a dynamic polishing head and held in place by a plastic retaining ring. The dynamic polishing head is rotated during polishing. This approach aids in removal of material and tends to even out any irregular topography, making the wafer flat or planar. This may be necessary in order to set up the wafer for the formation of additional circuit elements. For example, this might be necessary in order to bring the entire surface within the depth of field of a photolithography system, or to selectively remove material based on its position. Typical depth-of-field requirements are down to Angstrom levels for the latest sub-50 nanometer technology nodes.

The process of material removal is not simply that of abrasive scraping, like sandpaper on wood. The chemicals in the slurry also react with and/or weaken the material to be removed. The abrasive accelerates this weakening process and the polishing pad helps to wipe the reacted materials from the surface. In addition to advances in slurry technology, the polishing pad plays a significant role in increasingly complex CMP operations.

However, additional improvements are needed in the evolution of CMP pad technology.

SUMMARY

Embodiments of the present invention include coated compressive subpads for polishing pad stacks and methods of fabricating coated compressive subpads for polishing pad stacks.

In an embodiment, a polishing pad stack for polishing a substrate includes a polishing pad having a polishing surface and a back surface. The polishing pad stack also includes a compressive subpad with a first surface having a first pressure sensitive adhesive layer coated thereon. The first surface of the compressive subpad is coupled directly to the back surface of the polishing pad by the first pressure sensitive adhesive layer.

In another embodiment, a method of fabricating a polishing pad stack for polishing a substrate involves coating a first pressure sensitive adhesive layer on a first surface of a compressive subpad material. The method also involves coating a second pressure sensitive adhesive layer on a second, opposite, surface of the compressive subpad material. The method also involves adhering the first surface of the compressive subpad material directly to a back surface of a polishing pad by the first pressure sensitive adhesive layer.

In another embodiment, a subpad for a polishing pad stack includes a compressive subpad material having a first surface and a second, opposite, surface. A first pressure sensitive adhesive layer is coated on the first surface of the compressive subpad material. A first release liner is disposed on the first pressure sensitive adhesive layer. A second pressure sensitive adhesive layer is coated on the second surface of the compressive subpad material.

DETAILED DESCRIPTION

Coated compressive subpads for polishing pad stacks and methods of fabricating coated compressive subpads for polishing pad stacks are described herein. In the following description, numerous specific details are set forth, such as specific polishing pad and subpad compositions and designs, in order to provide a thorough understanding of embodiments of the present invention. It will be apparent to one skilled in the art that embodiments of the present invention may be practiced without these specific details. In other instances, well-known processing techniques, such as details concerning the combination of a slurry with a polishing pad to perform CMP of a semiconductor substrate, are not described in detail in order to not unnecessarily obscure embodiments of the present invention. Furthermore, it is to be understood that the various embodiments shown in the figures are illustrative representations and are not necessarily drawn to scale.

Polishing pads for CMP operations may have trade-offs in performance such as a trade-off between across-wafer polishing uniformity versus within die polishing uniformity. For example, hard polishing pads may exhibit good die-level planarization, but poor across-wafer uniformity. A compressible subpad can be included with a polishing pad or layer to improve the global non-uniformity performance of the overlying polishing pad or layer.

In accordance with one or more embodiments herein, double coated subpads are described, such as double coated foam subpads. For example, an adhesive coated foam can be used as a foundation (subpad) layer for CMP polishing pads. The adhesive coated foam may be made using one or combination of the following features: (1) the adhesive may be directly coated onto one surface of the subpad material, (2) the adhesive can be directly coated onto both surfaces of the subpad material, (3) one adhesive can be a removable adhesive to enable application of a subpad/polishing layer pairing to a platen, and/or (4) one adhesive can be a permanent adhesive to promote strong bonding of the subpad to the back side of the polishing pad or layer.

To provide context, state of the art for subpad coupling to a polishing pad or layer involves use of a two-sided tape (such as a pressure sensitive adhesive, PSA, two-sided tape) to bond the subpad to the polishing pad. A second two-sided tape is laminated to the side of the subpad that will ultimately be coupled to a platen of a CMP apparatus. For example, fabrication of a polishing pad stack can involve laminating a PSA two-sided tape to both of the subpad faces.

Figure 1:
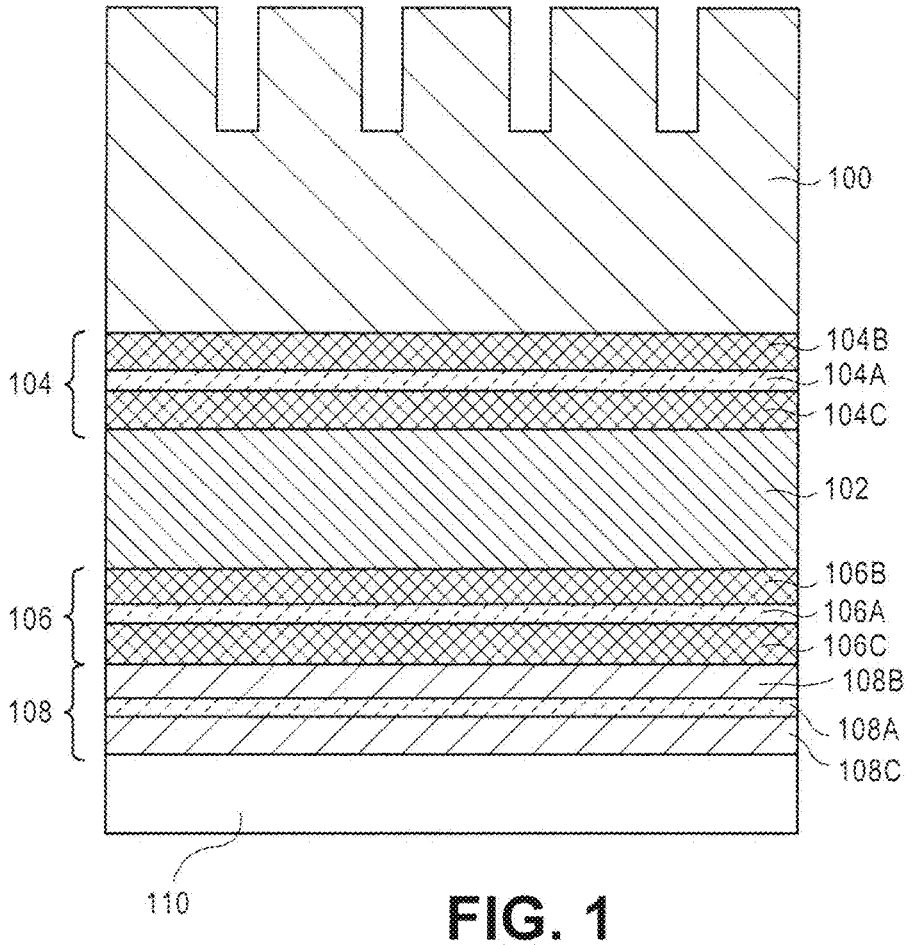
FIG. 1 (PRIOR ART)
FIG. 1 illustrates a cross-sectional view of a state of the art polishing pad and subpad pairing.

FIG. 1 illustrates a cross-sectional view of a state of the art polishing pad and subpad pairing. Referring to FIG. 1, a polishing pad 100 (top pad or polishing layer) is coupled to a subpad 102. The face of the subpad 102 proximate to the top pad 100 is coupled to the top pad 100 by a first PSA two-sided tape 104. The first PSA two-sided tape 104 may include a carrier film 104A (such as a polyethylene terephthalate, PET, film) which has a first permanent PSA layer 104B and a second permanent PSA layer 104C thereon. The face of the subpad 102 distal from the top pad 100 has a second PSA two-sided tape 106 thereon. The second PSA two-sided tape 106 may include a carrier film 106A (such as a PET film) which has a first permanent PSA layer 106B and a second permanent PSA layer 106C thereon. The second PSA two-sided tape 106 may be further coupled to a third PSA two-sided tape 108. The third PSA two-sided tape 108 may include a carrier film 108A (such as a PET film) which has a first permanent PSA layer 108B and a second removable PSA layer 108C thereon. The third PSA two-sided tape 108 may be suitable for removably coupling the top pad 100/subpad 102 polishing pad stack to a platen 110 of a CMP polishing apparatus, as is depicted in FIG. 1. There may be disadvantages associated with the type of polishing pad stack depicted in FIG. 1, as described below.

Figure 2:
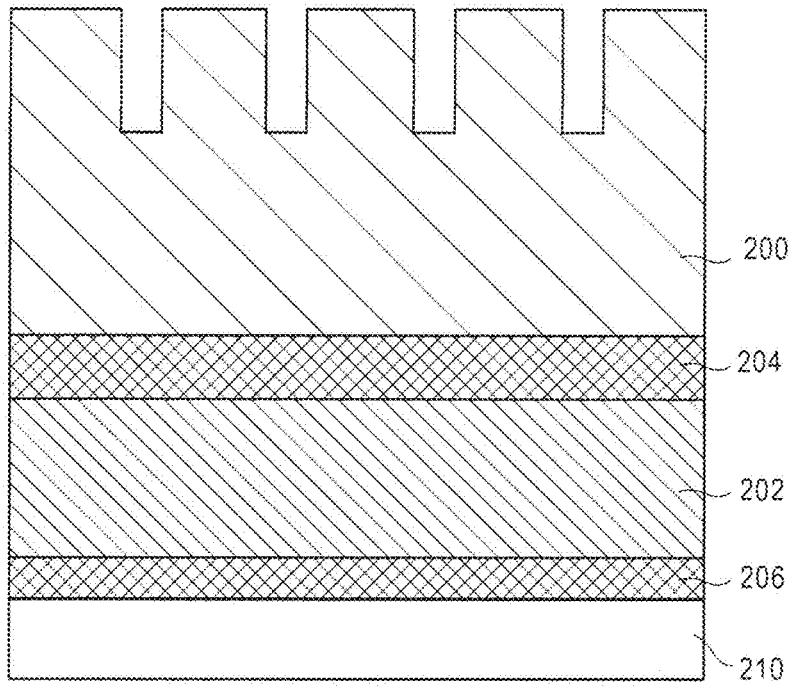
FIG. 2 illustrates a cross-sectional view of a polishing pad and subpad pairing, in accordance with an embodiment of the present invention.

In contrast to the polishing pad stack of FIG. 1, FIG. 2 illustrates a cross-sectional view of a polishing pad and subpad pairing, in accordance with an embodiment of the present invention. Referring to FIG. 2, a polishing pad stack for polishing a substrate includes a polishing pad 200 (top pad or polishing layer) coupled to a subpad 202, which may be a compressive subpad. The polishing pad 200 has a polishing surface distal from the subpad 202, and a back surface proximate to the subpad 202. A first (upper) surface of the subpad 202 has a first pressure sensitive adhesive layer 204 coated thereon. The upper surface of the subpad 202 is coupled directly to the back surface of the polishing pad 200 by the first pressure sensitive adhesive layer 204.

Referring again to FIG. 2, in an embodiment, the polishing pad stack further includes a second pressure sensitive adhesive layer 206 coated on a second (lower) surface of the compressive subpad 202. In one such embodiment, the first pressure sensitive adhesive layer 204 is a permanent pressure sensitive adhesive layer for strong adhesion to the polishing pad 200. The second pressure sensitive adhesive layer 206 is a removable pressure sensitive adhesive layer and is for removably coupling the polishing pad stack to a platen 210 of a chemical mechanical polishing apparatus. Although depicted in FIG. 2 as already coupled to a platen, in an embodiment, the polishing pad stack of FIG. 2 may include a release liner on the second pressure sensitive adhesive layer 206. Such a release liner may be used for transport and storage of a polishing pad stack, and may be removed to expose the second pressure sensitive adhesive layer 206 prior to coupling the polishing pad stack to a platen.

Advantages of the polishing pad stack of FIG. 2 over the polishing pad stack of FIG. 1 may be realized from the non-interrupted subpad construction achieved with the polishing pad stack type of FIG. 2. In particular, the number of interfaces is limited for adhesion failure. Additionally, there may be less processing of the adhesive layers of the polishing pad stack of FIG. 2, as is described in greater detail below. In an embodiment, direct coating of an adhesive onto a compressive subpad surface aids in sealing foam pores in the case of a compressive foam subpad. Furthermore, the overall pad thickness may be reduced since there are no carrier films associated with the pressure sensitive adhesive layers, and the number of layers in the composite material is limited. In an embodiment, direct adhesive coating offers superior adhesive anchorage to low surface energy foam that would otherwise be difficult when laminating a PSA two-sided tape to the surface of the subpad. Finally, the number of manufacturing operations may be reduced from four to as low as one lamination operation (the lamination a coated subpad to a polishing pad), as is described in greater detail below. Such a reduction in lamination operations and the achieved simplicity of construction of the polishing pad stack can result in potential reductions in manufacturing cost of the polishing pad stack.

Referring again to FIG. 2, a pressure sensitive adhesive layer, such as permanent pressure sensitive adhesive layer 204 or removable adhesive layer 206, requires only light to moderate pressure to adhere to a workpiece (such as light to moderate pressure to adhere a subpad 202 having a pressure sensitive adhesive layer coated thereon to a polishing pad 200). A pressure sensitive adhesive layer is not a glue layer which would otherwise require some level of curing. A pressure sensitive adhesive layer is also not a hot melt layer which otherwise requires heat for the adhesion to a workpiece. A pressure sensitive adhesive layer, as defined herein, also does not require the addition of water to activate the adhesion to a workpiece.

Referring again to FIG. 2, in an embodiment, the permanent pressure sensitive adhesive layer 204 has a peel strength of greater than approximately 4.5 pounds per inch at 25 degrees Celsius. The removable pressure sensitive adhesive layer 206 has a peel strength of less than approximately 4 pounds per inch at 25 degrees Celsius. In a particular embodiment, the removable pressure sensitive adhesive layer 206 has a peel strength of less than approximately 2.5 pounds per inch at 25 degrees Celsius. As used herein, peel strength is defined as strength at maximum adhesion of the pressure sensitive layer, where the test method use is defined in ASTM D3330. In an embodiment, the permanent pressure sensitive adhesive layer 204 or the removable pressure sensitive adhesive layer 206, or both, is a layer of material such as, but not limited to, an acrylic material, a rubber, ethylene vinyl acetate, a silicone material, or a block co-polymer. The layer often incudes a tackifying resin in the formulation. In an embodiment, the permanent pressure sensitive adhesive layer 204 or the removable pressure sensitive adhesive layer 206, or both, has a thickness of approximately 2 mils.

As mentioned briefly above, in an embodiment, the compressive subpad 202 is a compressive foam subpad. In one such embodiment, the compressive foam subpad is post processed foam material (e.g., processed using a Corona treatment, as described in greater detail below) that provides improved thickness uniformity or improved surface energetics, or both. In an embodiment, the compressive foam subpad is composed of a material such as, but not limited to, an ethylene vinyl acetate closed cell foam material, a polyethylene closed cell foam material, or a polyurethane mostly closed cell foam material. In an embodiment, one or both of the surface of the compressive subpad (i.e., the surface that is coupled to a polishing pad or the surface for coupling to a platen) has a surface energy approximately in the range of 30-40 dyne/cm$^2$ (as measured prior to any post processing such as a Corona treatment). In an embodiment, the compressive subpad has a thickness approximately in the range of 10 mils to 40 mils.

Figure 3B:
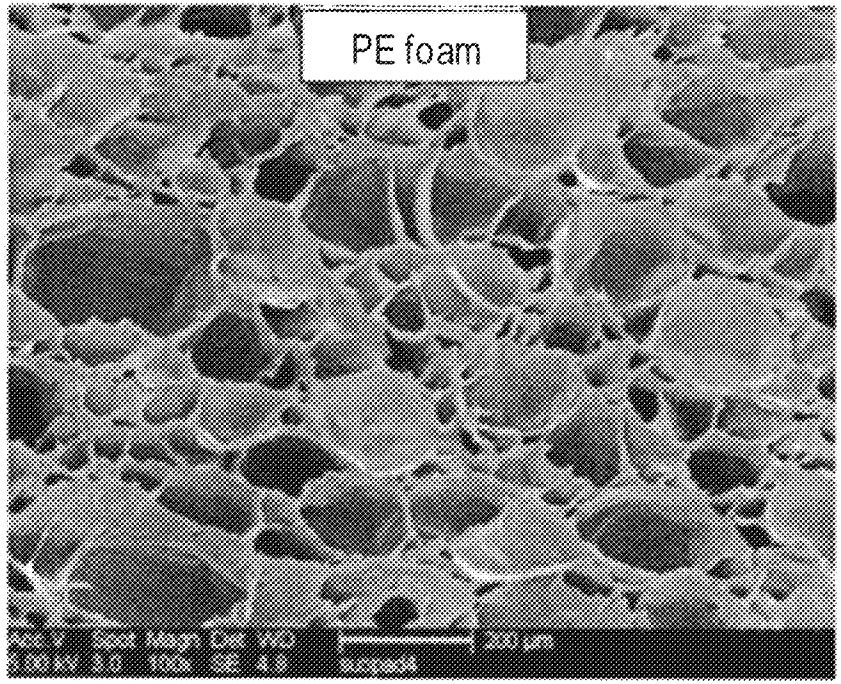
FIG. 3B is cross-sectional scanning electron microscope (SEM) image of another exemplary compressive foam subpad, in accordance with another embodiment of the present invention.
Figure 3A:
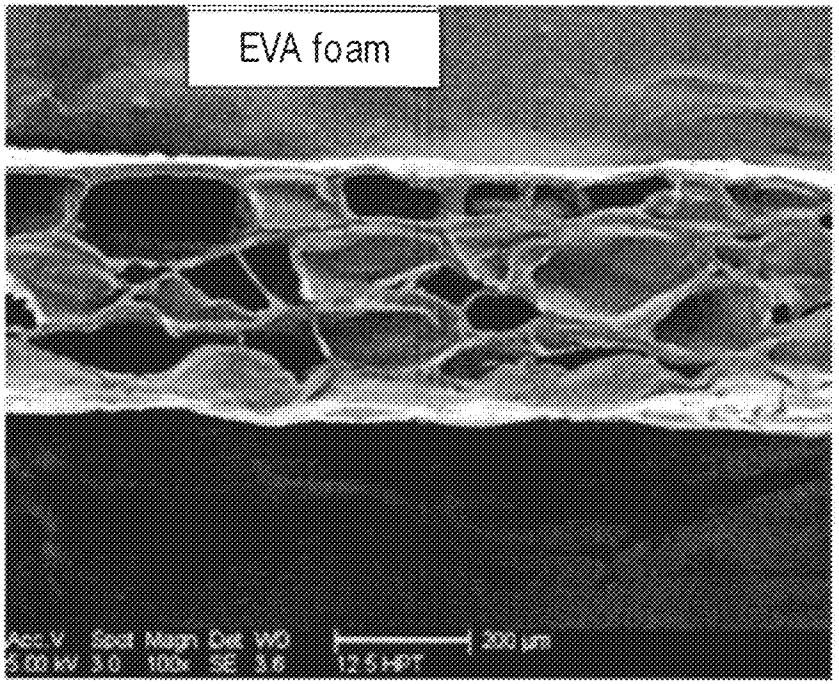
FIG. 3A is cross-sectional scanning electron microscope (SEM) image of an exemplary compressive foam subpad, in accordance with an embodiment of the present invention.

FIGS. 3A and 3B are cross-sectional scanning electron microscope (SEM) images of exemplary compressive foam subpads, in accordance with an embodiment of the present invention. Referring to SEM image 300A of FIG. 3A, a closed cell ethyl vinyl acetate (EVA) foam subpad is shown magnified at 100× magnification. Referring to SEM image 300B of FIG. 3B, a closed cell polyethylene (PE) foam subpad is shown magnified at 100× magnification.

Referring again to FIGS. 3A and 3B, in an embodiment, the subpad foam layer is an EVA foam or polyethylene foam having low surface energy, typically 30-35 dyne/cm$^2$. The surface energy is typically measured with an Accu Dyne pen that applies a simple solution using ASTM standard Test Method D 2578. The most common solution used includes ethyl cellosolve, formamide and a dye to make it easier to detect with the naked eye. The variation in concentration of the ethyl cellosolve % vs. the formamide % results in different dyne level solutions with each pen.

Referring again to FIG. 2, the permanent pressure sensitive adhesive layer 204 is coated on the surface of the subpad 202 proximate to the polishing pad 200. The removable pressure sensitive adhesive layer 206 is coated on the surface of the subpad 202 distal to the polishing pad 200. Use of the term "coated" is used to distinguish embodiments of the present invention from situations where a PSA such as a PSA two-sided tape is laminated on the surface of a subpad for ultimate coupling of the subpad to a polishing pad or to a platen (depending on the side of the subpad having the PSA laminated thereon). The term "coated" is also used to distinguish embodiments of the present invention from situations where a PSA such as a PSA two-sided tape is first laminated on the back surface of a polishing pad and subsequently used to adhere the polishing pad to the subpad through another lamination process. By contrast, in accordance with embodiments described herein, an adhesive layer is coated on a surface of a subpad as a "wet" layer by a process such as, but not limited to, a dipping process, a rolling process, or a spreading process. The coated layer is then dried to remove any carrier solvents used to apply the adhesive material on the surface of the subpad. The dried layer coated on a subpad surface is the pressure sensitive adhesive layer (either permanent or removable, depending on which side of the subpad is referenced).

Figure 4B:
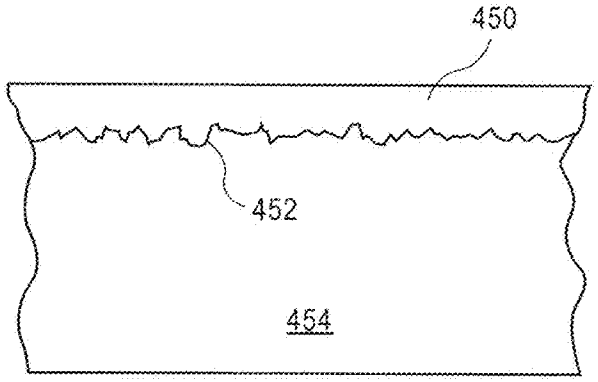
FIG. 4B illustrates a cross-sectional view of a subpad having a pressure sensitive adhesive layer coated thereon, in accordance with an embodiment of the present invention.
Figure 4A:
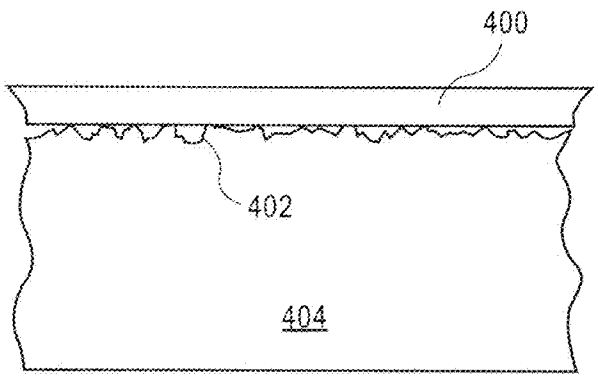
FIG. 4A (PRIOR ART)
FIG. 4A illustrates a cross-sectional view of a state of the art subpad having an adhesive film laminated thereon.

As an exemplary advantage of a coated adhesive layer as opposed to a laminated adhesive film on the surface of a subpad, embodiments of the present invention provide a pressure sensitive adhesive layer on the surface of a subpad where the surface area contact between the pressure sensitive adhesive layer and the surface of the subpad is greater than approximately 90%, and in some embodiments greater than approximately 95%. FIG. 4A illustrates a cross-sectional view of a state of the art subpad having an adhesive film laminated thereon. FIG. 4B illustrates a cross-sectional view of a subpad having a pressure sensitive adhesive layer coated thereon, in accordance with an embodiment of the present invention.

Referring to FIG. 4A, a conventional laminated adhesive sheet 400 may not have substantial surface area contact between the laminated sheet 400 and a topographical surface 402 of a closed cell sub pad 404. As shown in FIG. 4A, the laminated adhesive sheet 400 does not substantially fill surface voids/topography 402 of a surface of the subpad 404. It is to be appreciated that the same scenario may occur for the other (bottom) surface of the subpad 404.

By contrast, in accordance with an embodiment of the present invention, referring to FIG. 4B, a coated pressure sensitive adhesion layer 450 substantially fills surface voids/topography 452 of a surface of a subpad 454. The result can be an ultimate increase in adhesion strength between the pressure sensitive adhesion layer 450 and the subpad 454. It is to be appreciated that the same scenario may occur for the other (bottom) surface of the subpad 454. In an exemplary embodiment, the surface 452 of the compressive subpad 454 has a surface roughness of at least 3 microns and has a total surface area. The coated pressure sensitive adhesive layer 450 is in direct contact with at least 90% of the total surface area of the surface 452 of the compressive subpad 454. In some embodiment, the coated pressure sensitive adhesive layer 450 is in direct contact with greater than approximately 95% of the total surface area of the surface 452 of the compressive subpad 454.

Referring again to FIG. 2, in an embodiment, the polishing pad 200 coupled to the subpad 202 is a homogeneous or single layer polishing pad, as is depicted in FIG. 2. In one such embodiment, the polishing pad 200 is composed of a thermoset polyurethane material, as described in greater detail below. In another embodiment, however, the polishing pad 200 is a composite polishing pad. In one such embodiment, the polishing pad 200 includes a polishing layer and a foundation layer that together define the polishing pad 200.

Figure 5:
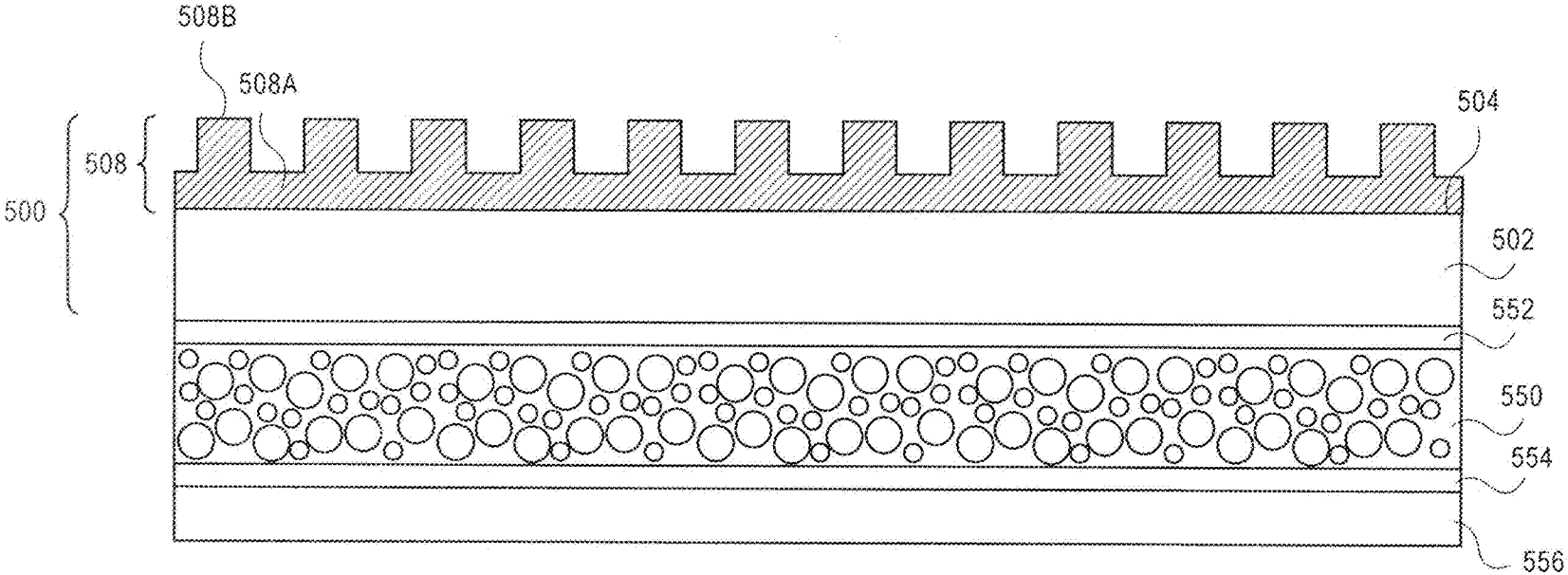
FIG. 5 illustrates a cross-sectional view of a polishing pad and subpad pairing where the polishing pad includes a polishing layer and a foundation layer, in accordance with an embodiment of the present invention.

As an example of the latter scenario, FIG. 5 illustrates a cross-sectional view of a polishing pad and subpad pairing where the polishing pad includes a polishing layer and a foundation layer, in accordance with an embodiment of the present invention. Referring to FIG. 5, a polishing pad stack includes a polishing pad 500. The polishing pad includes a polishing layer 508 coupled to a foundation layer 502. As such, the back surface of the polishing pad 500 is a surface of the foundation layer 502. The front surface 504 of the foundation layer 502 is bonded to a surface polishing layer 508. In an embodiment, the polishing surface layer 508 includes a continuous layer portion 508A with a plurality of polishing features 508B protruding there from, as depicted in FIG. 5. It is the continuous layer portion 508A that is bonded with the foundation layer 502.

In an embodiment, the foundation layer 502 is composed of a polycarbonate material, and the polishing surface layer 508 is a polyurethane material. In a specific such embodiment, the polishing surface layer 508 is covalently bonded to the foundation layer 502. The term "covalently bonded" refers to arrangements where atoms from a first material (e.g., the material of a polishing surface layer) are cross-linked or share electrons with atoms from a second material (e.g., the material of a foundation layer) to effect actual chemical bonding. Covalent bonding is distinguished from mechanical bonding, such as bonding through screws, nails, glues, or other adhesives. In another specific embodiment, the polishing surface layer 508 is not covalently bonded, but is rather only electrostatically bonded (yet still directly bonded), to the foundation layer 502. Such electrostatic bonding may involve van der Waals type interactions between the foundation layer 502 and the polishing surface layer 508.

Referring again to FIG. 5, the polishing pad stack includes subpad 550, which may be a compressive closed cell foam subpad. A first (upper) surface of the subpad 550 has a first pressure sensitive adhesive layer 552 coated thereon. The upper surface of the subpad 550 is coupled directly to the back surface of the foundation layer 502 of the polishing pad 500 by the first pressure sensitive adhesive layer 552. In an embodiment, a second pressure sensitive adhesive layer 554 is coated on a second (lower) surface of the compressive subpad 550. In one such embodiment, the first pressure sensitive adhesive layer 552 is a permanent pressure sensitive adhesive layer for strong adhesion to the polishing pad 500. The second pressure sensitive adhesive layer 554 is a removable pressure sensitive adhesive layer and is for removably coupling the polishing pad stack to a platen 556 of a chemical mechanical polishing apparatus. Although depicted in FIG. 5 as already coupled to a platen, in an embodiment, the polishing pad stack of FIG. 5 may include a release liner on the second pressure sensitive adhesive layer 554. Such a release liner may be used for transport and storage of a polishing pad stack, and may be removed to expose the second pressure sensitive adhesive layer 554 prior to coupling the polishing pad stack to a platen.

Figure 6:
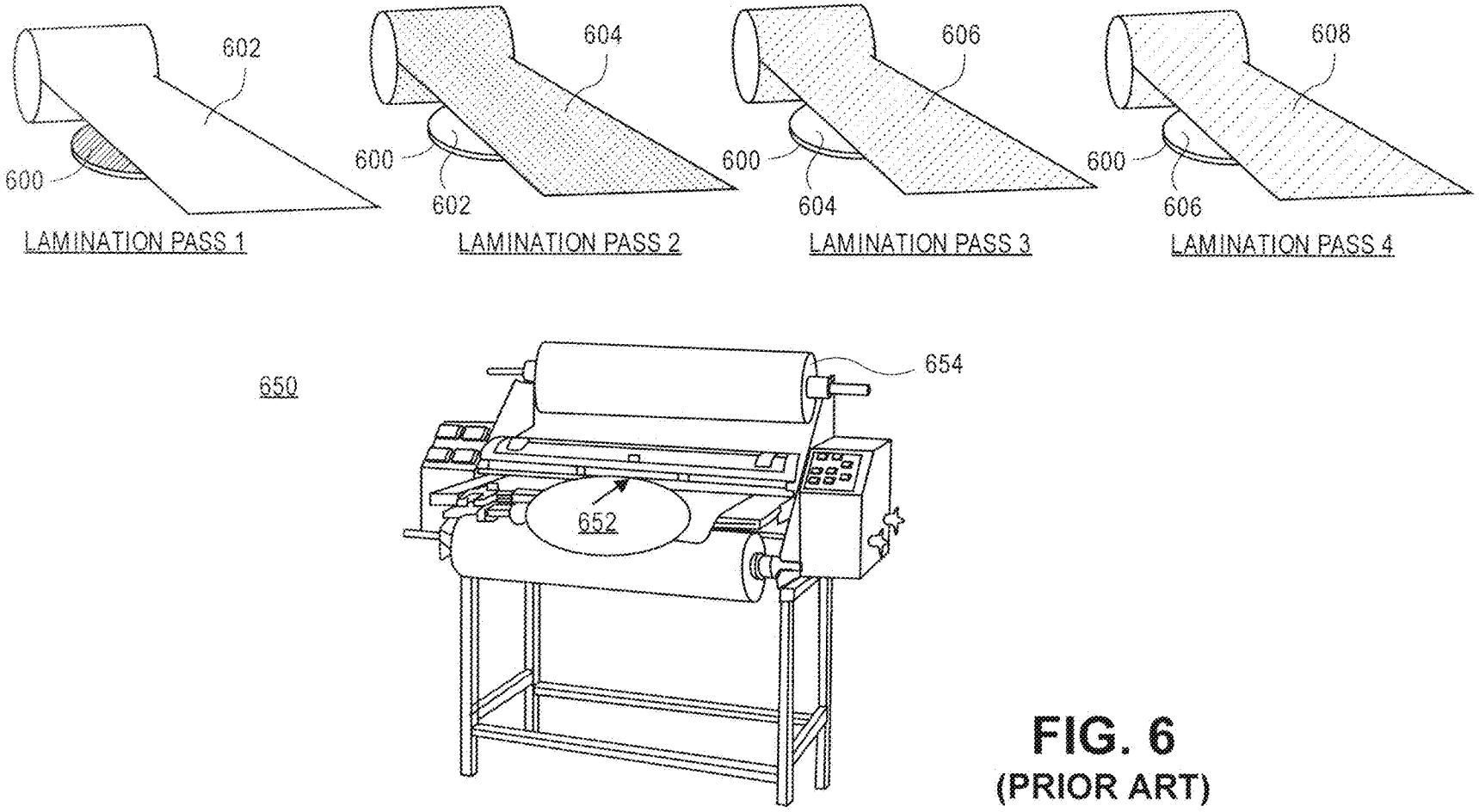
FIG. 6 (PRIOR ART)
FIG. 6 illustrates a state of the art four step lamination pass pad/subpad fabrication process.

As mentioned briefly above, polishing pad stacks including subpads such as those described herein may be fabricated using a reduced number of lamination processes than are otherwise used for state of the art pad stack fabrication. As a comparative example, FIG. 6 illustrates a state of the art four step lamination pass pad/subpad fabrication process. Referring to FIG. 6, a first lamination pass (Lamination Pass 1) involves lamination of a permanent PSA two-sided tape 602 on the back side of a polishing pad (top pad) 600. Excess of the permanent PSA two-sided tape is then trimmed off. A second lamination pass (Lamination Pass 2) involves lamination of a subpad foam material 604 onto the permanent PSA two-sided tape 602 on the back up the polishing pad 600. Excess of the foam material is then trimmed off. A third lamination pass (Lamination Pass 3) involves lamination of a second permanent PSA two-sided tape 606 onto the subpad foam material 604. Excess of the second permanent PSA two-sided tape is then trimmed off. A fourth lamination pass (Lamination Pass 4) involves lamination of a removable PSA two-sided tape 608 onto the second permanent PSA two-sided tape 606. Excess of the removable PSA two-sided tape is then trimmed off. A laminator 650 may be used where the polishing pad 652 is laminated with a roll 654 of the permanent PSA two-sided tape 602, the subpad foam material 604, the second permanent PSA two-sided tape 606 or the removable PSA two-sided tape 608, depending on which lamination pass is being performed. The resulting pad stack may be one such as described in association with FIG. 1.

Figure 7:
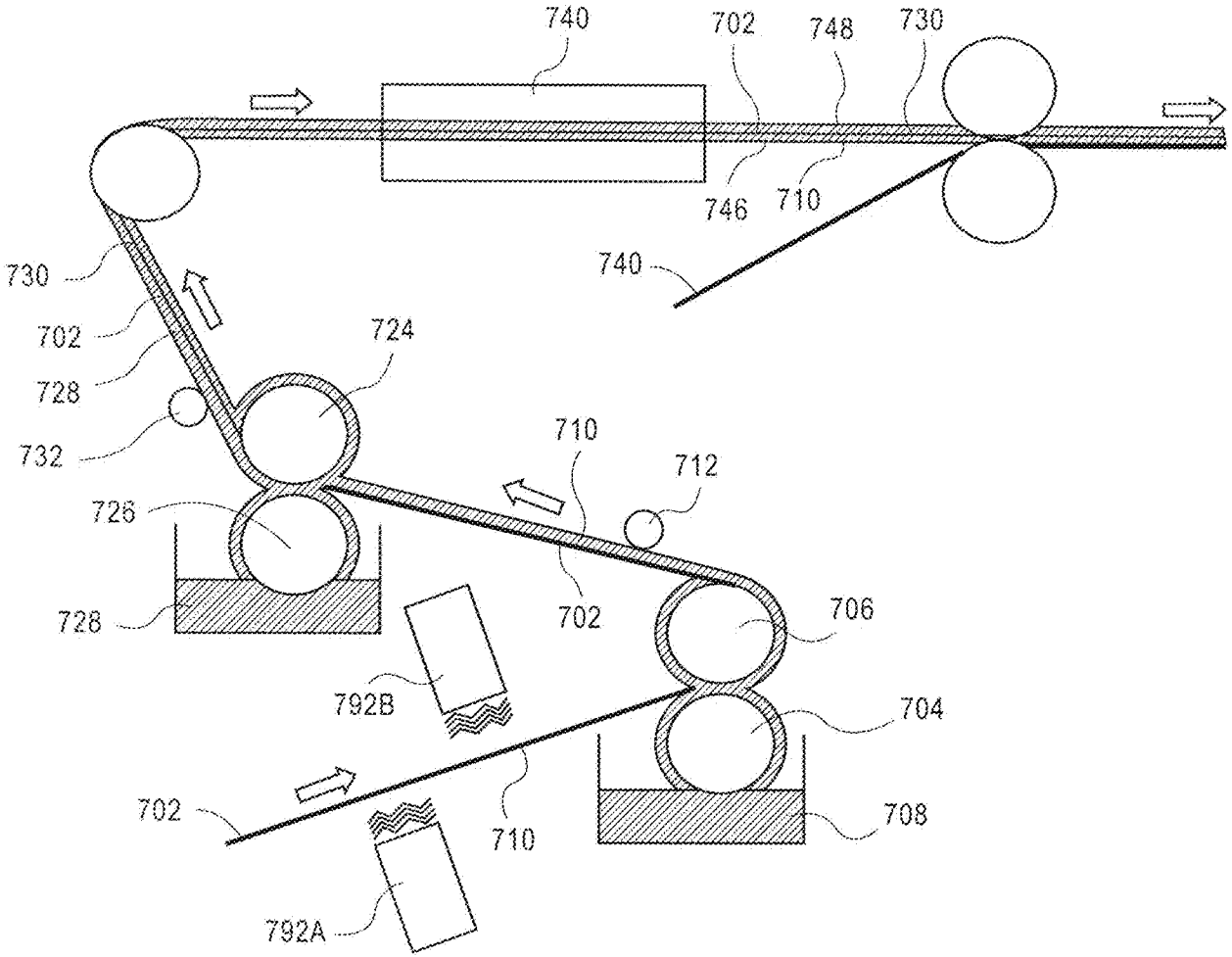
FIG. 7 illustrates a subpad fabrication process involving coating of pressure sensitive adhesive layers onto the subpad material, in accordance with an embodiment of the present invention.

In contrast to the above described multi-lamination process, FIG. 7 illustrates a subpad fabrication process involving coating of pressure sensitive adhesive layers onto the subpad material, in accordance with an embodiment of the present invention.

Referring to FIG. 7, a subpad foam material 702 is used as a carrier film for a coating process. The subpad foam material 702 is fed into application rollers 704 and 706 which apply a first pressure sensitive adhesive material 708 onto a first side 710 of the subpad foam material 702. A spreader bar or Meyer bar 712 is used to remove excess of and to evenly distribute the first pressure sensitive adhesive material 708 on the first side 710 of the subpad foam material 702.

Referring again to FIG. 7, the subpad foam material 702 is then fed into application rollers 724 and 726 which apply a second pressure sensitive adhesive material 728 onto a second side 730 of the subpad foam material 702. A spreader bar or Meyer bar 732 is used to remove excess of and to evenly distribute the second pressure sensitive adhesive material 728 on the second side 730 of the subpad foam material 702.

Referring again to FIG. 7, the doubly coated subpad foam material 702 is then directed to a dryer 740. The drying provides a foam material 702 having a first surface 710 with a first pressure sensitive adhesive layer 746 coated thereon, and having a second surface 730 with a second pressure sensitive adhesive layer 748 coated thereon. Once transported through the dryer 740, further processing of the foam material 702 having the first 746 and second 748 pressure sensitive adhesive layers thereon may be performed, as described in greater detail below.

Referring generally to FIG. 7, in an embodiment, a method of fabricating a polishing pad stack for polishing a substrate involves coating a first pressure sensitive adhesive layer 708 on a first surface 710 of a compressive subpad material 702. The method also involves coating a second pressure sensitive adhesive layer 728 on a second, opposite, surface 730 of the compressive subpad material 702. In an embodiment, the first pressure sensitive adhesive layer 708 is a permanent pressure sensitive adhesive layer, and the second pressure sensitive adhesive layer 728 is a removable pressure sensitive adhesive layer. In another embodiment, the first pressure sensitive adhesive layer 708 is a removable pressure sensitive adhesive layer, and the second pressure sensitive adhesive layer 728 is a permanent pressure sensitive adhesive layer. In either case, in an embodiment, for the removable pressure sensitive adhesive layer, a primer is applied to the associated side of the subpad material for increasing the adhesion of the removable pressure sensitive adhesive layer to the subpad material but retaining removability for the platen side of the removable pressure sensitive adhesive layer.

In an embodiment, coating of either the first or second pressure sensitive adhesive layer involves dispensing and then spreading a solvent-based adhesive formulation on a surface of the compressive subpad material. In one such embodiment, subsequent to dispensing and then spreading a first solvent-based adhesive formulation on a first surface of the compressive subpad material and dispensing and then spreading a second solvent-based adhesive formulation on a second surface of the compressive subpad material, the first and second solvent-based adhesive formulations are dried (e.g., through dryer 740) to remove substantially all solvent from the first and second solvent-based adhesive formulations. In an embodiment, a pressure sensitive adhesive layer is applied as a solvent-based adhesive formulation on a surface of the compressive subpad material at a temperature less than approximately 50 degrees Celsius. Subsequently, the solvent-based adhesive formulation is dried in an air dryer at a temperature less than approximately 50 degrees Celsius.

Figure 8:
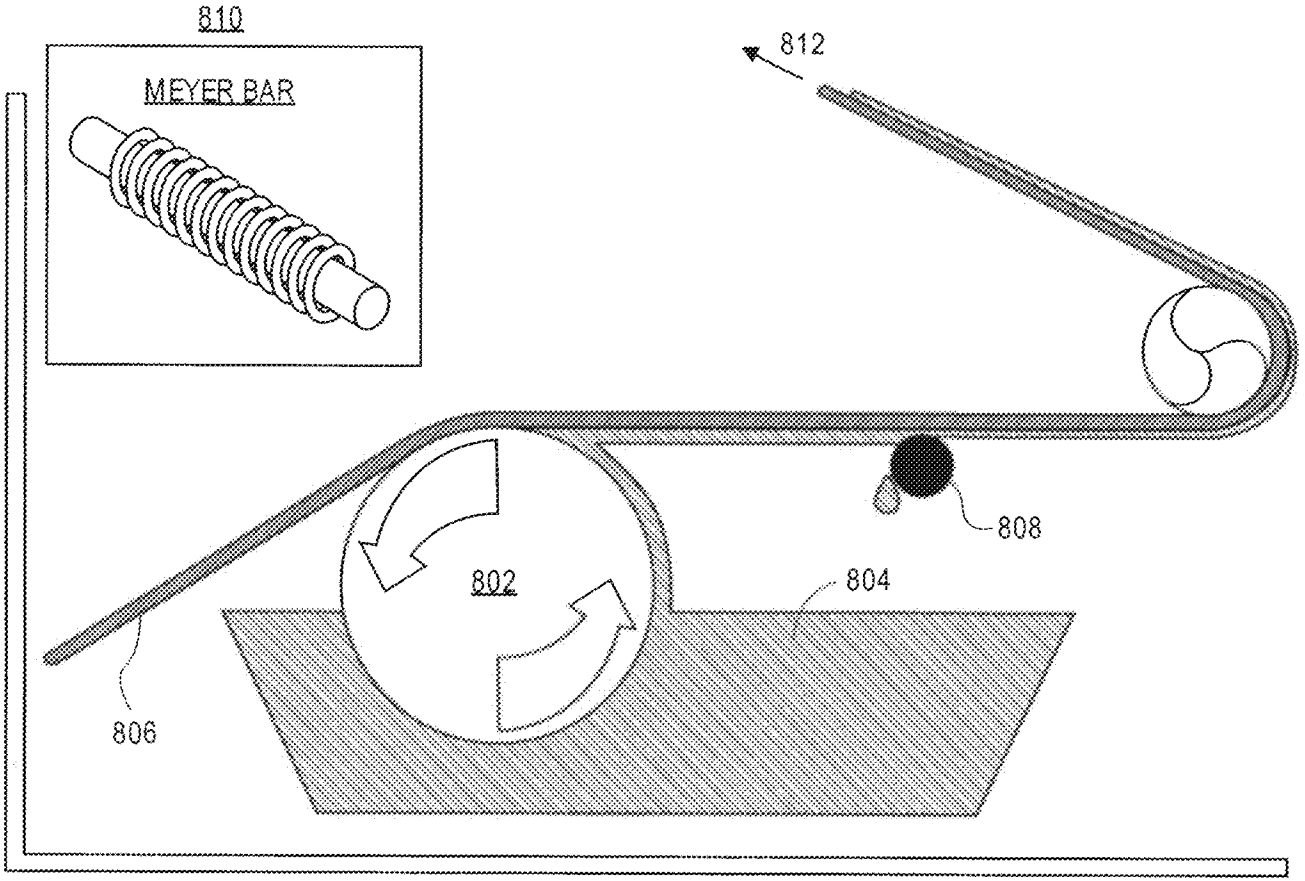
FIG. 8 illustrates coating of a pressure sensitive adhesive layer onto a subpad material using a Meyer bar, in accordance with an embodiment of the present invention.

Thus, referring generally to FIG. 7, providing PSA layers on a subpad material involves coating an adhesive/solvent solution onto the subpad material which acts a carrier film or a support layer in the fabrication process. The viscosity of the adhesive formulation determines the coating method. The adhesive formulation can be applied as an adhesive material carried in a solvent. An exemplary coating method is a Meyer Rod Coating approach. FIG. 8 illustrates coating of a pressure sensitive adhesive layer onto a subpad material using a Meyer bar, in accordance with an embodiment of the present invention.

Referring to FIG. 8, an applicator roll 802 delivers an adhesive formulation 804 to the surface of a subpad material 806 being coated. In an embodiment, the adhesive formulation 804 is applied at a temperature less than approximately 50 degrees Celsius and, preferably less than approximately 40 degrees Celsius, and most preferably at room temperature or approximately 20-25 degrees Celsius. In an embodiment, the temperature of the adhesive formulation 804 at the time of application is less than approximately 50 degrees Celsius and, preferably less than approximately 40 degrees Celsius, and most preferably at room temperature or approximately 20-25 degrees Celsius. The applicator roll 802 delivers an excess of material 804. The excess is removed by a Meyer rod or bar 808 (an expanded view of which is depicted in box 810 of FIG. 8, which shows the rod wrapped with wire). The amount of adhesive removed depends on the wire wrapping. There may be multiple rods in series to produce smooth accurate coating thicknesses with tolerance at +/−0.001 inch. The coated subpad material film is then directed 812 to an air dryer for solvent evaporation. In an embodiment, the subpad having the adhesive coated thereon enters the dryer approximately 2-4 minutes after the adhesive is coated on the subpad. In an embodiment, the subpad is dried in the air dryer for approximately 20 minutes.

Referring again to FIG. 7, a release liner 790 is then applied to one of the coated adhesive layers at the end of the coating process. In one embodiment, the release liner 790 is added to the removable pressure sensitive adhesive layer after the removable pressure sensitive adhesive layer has been coated on the subpad material. In other embodiments, however, the removable pressure sensitive adhesive layer is coated on the subpad material by first applying the removable pressure sensitive adhesive material to the release liner and then delivering the removable pressure sensitive adhesive material to the subpad material. In either case, such a release liner may be removed prior to coupling the removable pressure sensitive adhesive layer to a platen.

In an embodiment, although not depicted, a second release liner is added to the permanent pressure sensitive adhesive layer. Such a second release liner may be included for transporting or storage of a coated subpad, but removed prior to adhering the coated subpad to a polishing pad via the permanent pressure sensitive adhesive layer of the coated subpad. In other embodiments, however, a roll of the subpad material is formed without a release liner being included on the side of the subpad material having the permanent pressure sensitive adhesive layer thereon. Whether or not the second release liner is included, a polishing pad may be adhered to the coated permanent pressure sensitive adhesive layer of the subpad material by a lamination process (thus leaving a single lamination process in place of the four described in association with FIG. 6). The subpad material may then be cut around the shape of the polishing pad material.

As described herein, a release liner is a paper or plastic based carrier web material, which has a release agent on one or both sides of the release liner. The release agent provides a release effect against any type of a sticky material such as an adhesive. Release of the release liner involves separation of the release liner from the pressure sensitive adhesive layer.

With reference again to the process of FIG. 7, in an embodiment, the foam material (such as EVA or PE foam material) of the subpad is post processed prior to adhesive coating to achieve a tight gage tolerance of +/−1 mil throughout the web. Typically, the material is buffed on one or both sides. Such foams can vary in thickness from 15 mils up to 60 mils and may be produced in a wide range of densities ranging from a few pounds up to 60 pound foam. Typical gage tolerance is +/10% of the total thickness, which can be as much as +/−6 mils or a total of 12 mils throughout the web. It is to be appreciated that, as the semiconductor market technologies become more and more demanding to reduce line width, the consumable set used to manufacture these technologies must also meet tighter material property tolerances. Post processing of a foam and subsequent direct adhesive coating can, in an embodiment, reduce the thickness tolerance and provide improved adhesive anchorage. Such factors in turn affect the foam compressibility of the subpad material. Compressibility is defined as (thickness under a load minus initial thickness)/initial thickness. In some embodiment, the desired compressibility is low, e.g., typically less than 10%.

As described briefly in association with FIG. 7, a corona 792A and 792B or like treatment may be applied to one or both sides of a subpad material prior to adhesive layer coating. It is to be appreciated that surface energy properties are an important consideration with industrial coatings. The surface energy dictates if an applied coating will be accepted by the surface; this is known as wetting. The definition of wetting is the ability of a liquid to maintain contact with a solid surface, resulting from intermolecular interactions when the two are brought together. The degree of wetting (wettability) is determined by a force balance between adhesive and cohesive forces. For adhesive coatings, the surface tension of the adhesive must be lower than the surface energy of the surface to which they are applied. In the case of a material such as an EVA foam, the surface energy of the substrate must be raised to ensure sufficient wet out of the applied liquid (pressure sensitive adhesive coating). There are number of methods for such surface treatment such as, but not limited to corona discharge, flame treatment, or plasma treatment. Such treatments may be implemented to increase the surface energy of an EVA or PE foam from 30 dyne/cm up to, e.g., 40-42 dynes/cm. In one such embodiment, a corona discharge treatment is applied to a compressive foam subpad material just prior to the adhesive coating process, as is shown in FIG. 7.

Figure 9:
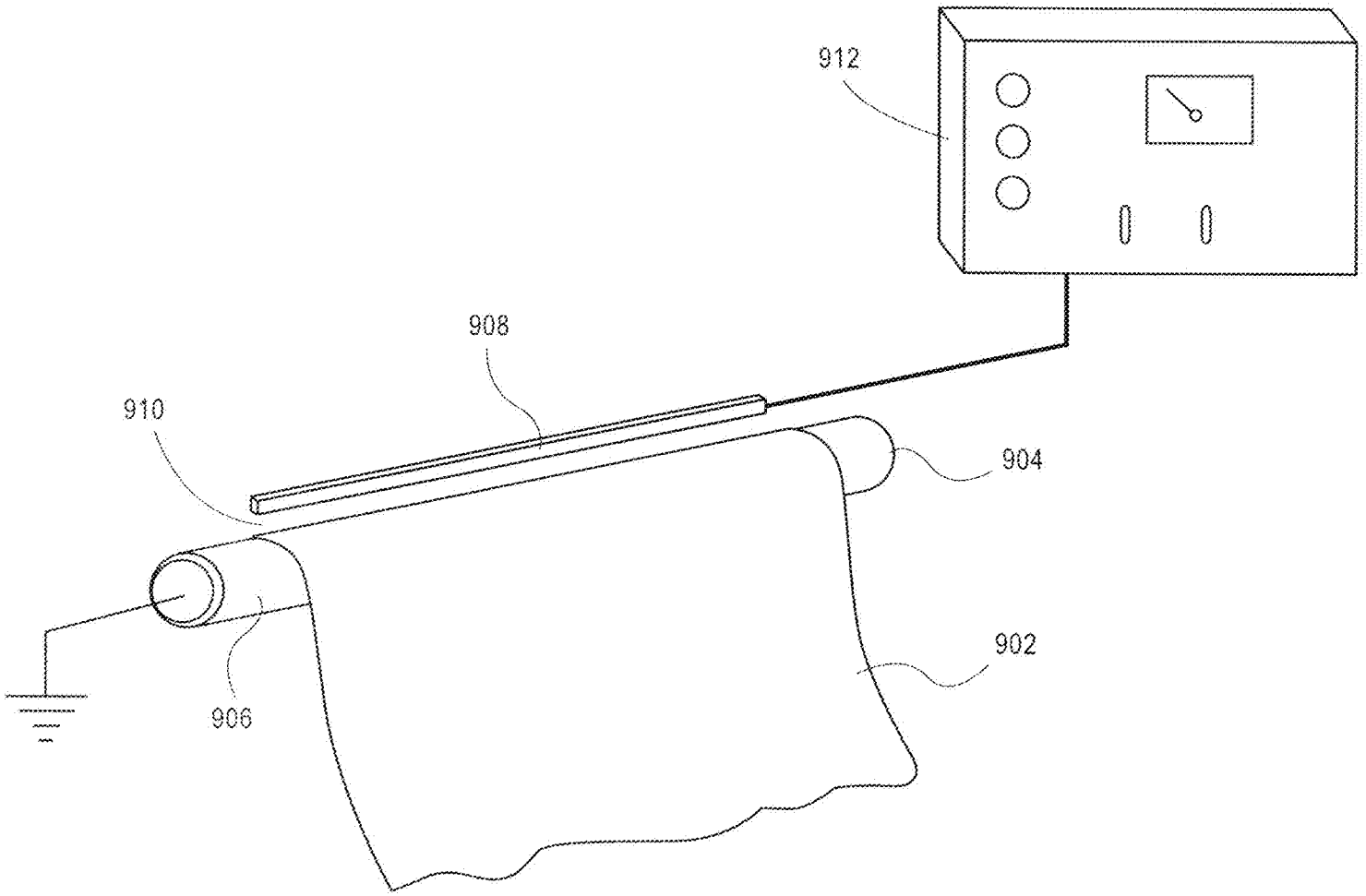
FIG. 9 illustrates an apparatus for performing a Corona discharge treatment of a compressive foam subpad surface prior to coating an adhesive layer thereon, in accordance with an embodiment of the present invention.

FIG. 9 illustrates an apparatus for performing a Corona discharge treatment of a compressive foam subpad surface prior to coating an adhesive layer thereon, in accordance with an embodiment of the present invention. Referring to FIG. 9, a subpad material layer 902 (e.g., compressive foam material layer) is rolled on a tamper roll 904 having a dielectric 906 thereon. The arrangement provides an electrode 908 above the subpad material layer 902 with an air gap 910 between the electrode 908 and the subpad material layer 902. A corona generator power supply 912 is coupled to the electrode 908. The corona treatment is a surface modification technique that uses a low temperature corona discharge plasma to impart changes in the properties of a surface of the subpad material layer 902.

In an embodiment, referring again to FIGS. 2 and 5, the polishing pad 200 or the polishing surface layer 508 is a homogeneous polishing pad or polishing surface layer. In one such embodiment, the homogeneous polishing pad or polishing surface layer is composed of a thermoset polyurethane material. For example, in a specific embodiment, the homogeneous polishing pad or polishing surface layer is composed of a thermoset, closed cell polyurethane material. In an embodiment, the term "homogeneous" is used to indicate that the composition of a thermoset, closed cell polyurethane material is consistent throughout the entire composition of the body. For example, in an embodiment, the term "homogeneous" excludes polishing pad bodies composed of, e.g., impregnated felt or a composition (composite) of multiple layers of differing material. In an embodiment, the term "thermoset" is used to indicate a polymer material that irreversibly cures, e.g., the precursor to the material changes irreversibly into an infusible, insoluble polymer network by curing. For example, in an embodiment, the term "thermoset" excludes polishing pads composed of, e.g., "thermoplast" materials or "thermoplastics"—those materials composed of a polymer that turns to a liquid when heated and returns to a very glassy state when cooled sufficiently. It is noted that polishing pads made from thermoset materials are typically fabricated from lower molecular weight precursors reacting to form a polymer in a chemical reaction, while pads made from thermoplastic materials are typically fabricated by heating a pre-existing polymer to cause a phase change so that a polishing pad is formed in a physical process. Polyurethane thermoset polymers may be selected for fabricating polishing pads described herein based on their stable thermal and mechanical properties, resistance to the chemical environment, and tendency for wear resistance.

The materials of polishing pad 200 or polishing surface layer 508 may be molded. The term "molded" may be used to indicate that the polishing surface layer is formed in a formation mold. In an embodiment, the molded polishing pad 200 or polishing surface layer 508, upon conditioning and/or polishing, has a polishing surface roughness approximately in the range of 1-5 microns root mean square. In one embodiment, the molded polishing pad 200 or polishing surface layer 508, upon conditioning and/or polishing, has a polishing surface roughness of approximately 2.35 microns root mean square. In an embodiment, the molded polishing pad 200 or polishing surface layer 508 has a storage modulus at 25 degrees Celsius approximately in the range of 30-500 megaPascals (MPa). In another embodiment, the molded polishing pad 200 or polishing surface layer 508 has a storage modulus at 25 degrees Celsius approximately less than 30 megaPascals (MPa).

The materials of polishing pad 200 or polishing surface layer 508 may include pore-forming features. In an embodiment, the polishing surface layer 108 or 208 has a pore density of closed cell pores approximately in the range of 6%-50% total void volume. In one embodiment, the plurality of closed cell pores is a plurality of porogens. For example, the term "porogen" may be used to indicate micro- or nano-scale spherical or somewhat spherical particles with "hollow" centers. The hollow centers are not filled with solid material, but may rather include a gaseous or liquid core. In one embodiment, the plurality of closed cell pores is composed of pre-expanded and gas-filled EXPANCEL™ distributed throughout (e.g., as an additional component in) a polishing surface layer of a polishing pad. In a specific embodiment, the EXPANCEL™ is filled with pentane. In an embodiment, each of the plurality of closed cell pores has a diameter approximately in the range of 10-100 microns. In an embodiment, the plurality of closed cell pores includes pores that are discrete from one another. This is in contrast to open cell pores which may be connected to one another through tunnels, such as the case for the pores in a common sponge. In one embodiment, each of the closed cell pores includes a physical shell, such as a shell of a porogen, as described above. In another embodiment, however, each of the closed cell pores does not include a physical shell. In an embodiment, the plurality of closed cell pores is distributed essentially evenly throughout a thermoset polyurethane material of a homogeneous polishing pad or polishing surface layer.

In an embodiment, polishing pad 200 or polishing surface layer 508 is opaque. In one embodiment, the term "opaque" is used to indicate a material that allows approximately 10% or less visible light to pass. In one embodiment, the polishing pad 200 or polishing surface layer 508 is opaque in most part, or due entirely to, the inclusion of an opacifying particle filler, such as a lubricant, throughout (e.g., as an additional component in) the polishing pad 200 or polishing surface layer 508. In a specific embodiment, the opacifying particle filler is a material such as, but not limited to boron nitride, cerium fluoride, graphite, graphite fluoride, molybdenum sulfide, niobium sulfide, talc, tantalum sulfide, tungsten disulfide, or Teflon®.

In another aspect, the polishing pad 200 or polishing surface layer 508 may have a pattern suitable for polishing during a CMP operation. In a first general example, some embodiments of the present invention include a plurality of protrusions having a pattern of linear features. In a second general example, some embodiments of the present invention include a plurality of protrusions having a pattern of discrete curved features. In a specific such example, discrete arc-shaped protrusions are included. Other specific such embodiments include, but are not limited to, a plurality of partial circumferential protrusions disposed on a substantially circular polishing pad. In a third general example, some embodiments of the present invention include a plurality of protrusions having a pattern of discrete tiles. In a specific such embodiment, discrete hexagonal tile protrusions are included. Other specific such embodiments include, but are not limited to, pluralities of circular tiles, oval tiles, square tiles, rectangular tiles, or a combination thereof.

Although the above three general examples are defined in terms of protrusions (e.g., the highest points of a patterned polishing surface layer), the polishing surface layers may also or alternatively be defined in terms of grooves (e.g., the lowest points of a patterned polishing surface layer). Individual grooves may be from about 4 to about 100 mils deep at any given point on each groove. In some embodiments, the grooves are about 10 to about 50 mils deep at any given point on each groove. The grooves may be of uniform depth, variable depth, or any combinations thereof. In some embodiments, the grooves are all of uniform depth. For example, the grooves of a groove pattern may all have the same depth. In some embodiments, some of the grooves of a groove pattern may have a certain uniform depth while other grooves of the same pattern may have a different uniform depth. For example, groove depth may increase with increasing distance from the center of the polishing pad. In some embodiments, however, groove depth decreases with increasing distance from the center of the polishing pad. In some embodiments, grooves of uniform depth alternate with grooves of variable depth.

Individual grooves may be from about 2 to about 100 mils wide at any given point on each groove. In some embodiments, the grooves are about 15 to about 50 mils wide at any given point on each groove. The grooves may be of uniform width, variable width, or any combinations thereof. In some embodiments, the grooves of a groove pattern are all of uniform width. In some embodiments, however, some of the grooves of a groove pattern have a certain uniform width, while other grooves of the same pattern have a different uniform width. In some embodiments, groove width increases with increasing distance from the center of the polishing pad. In some embodiments, groove width decreases with increasing distance from the center of the polishing pad. In some embodiments, grooves of uniform width alternate with grooves of variable width.

In accordance with the previously described depth and width dimensions, individual grooves may be of uniform volume, variable volume, or any combinations thereof. In some embodiments, the grooves are all of uniform volume. In some embodiments, however, groove volume increases with increasing distance from the center of the polishing pad. In some other embodiments, groove volume decreases with increasing distance from the center of the polishing pad. In some embodiments, grooves of uniform volume alternate with grooves of variable volume.

Grooves of the groove patterns described herein may have a pitch from about 30 to about 1000 mils. In some embodiments, the grooves have a pitch of about 125 mils. For a circular polishing pad, groove pitch is measured along the radius of the circular polishing pad. The grooves may be of uniform pitch, variable pitch, or in any combinations thereof. In some embodiments, the grooves are all of uniform pitch. In some embodiments, however, groove pitch increases with increasing distance from the center of the polishing pad. In some other embodiments, groove pitch decreases with increasing distance from the center of the polishing pad. In some embodiments, the pitch of the grooves in one sector varies with increasing distance from the center of the polishing pad while the pitch of the grooves in an adjacent sector remains uniform. In some embodiments, the pitch of the grooves in one sector increases with increasing distance from the center of the polishing pad while the pitch of the grooves in an adjacent sector increases at a different rate. In some embodiments, the pitch of the grooves in one sector increases with increasing distance from the center of the polishing pad while the pitch of the grooves in an adjacent sector decreases with increasing distance from the center of the polishing pad. In some embodiments, grooves of uniform pitch alternate with grooves of variable pitch. In some embodiments, sectors of grooves of uniform pitch alternate with sectors of grooves of variable pitch.

In an embodiment, polishing pad stacks described herein, such as the polishing pad stacks of FIGS. 2 and 5, are suitable for polishing substrates. The substrate may be one used in the semiconductor manufacturing industry, such as a silicon substrate having device or other layers disposed thereon. However, the substrate may be one such as, but not limited to, a substrates for MEMS devices, reticles, or solar modules. Thus, reference to "a polishing pad for polishing a substrate," as used herein, is intended to encompass these and related possibilities. In an embodiment, a polishing pad stack has a diameter approximately in the range of 20 inches to 30.3 inches, e.g., approximately in the range of 50-77 centimeters, and possibly approximately in the range of 10 inches to 42 inches, e.g., approximately in the range of 25-107 centimeters.

Subpads described herein may be included with a polishing pad, as described above. Such a combined polishing pad/subpad polishing pad stack may be suitable for use with a variety of chemical mechanical polishing apparatuses. As an example, FIG. 10 illustrates an isometric side-on view of a polishing apparatus compatible with a polishing pad/subpad polishing pad stack, in accordance with an embodiment of the present invention.

Figure 10:
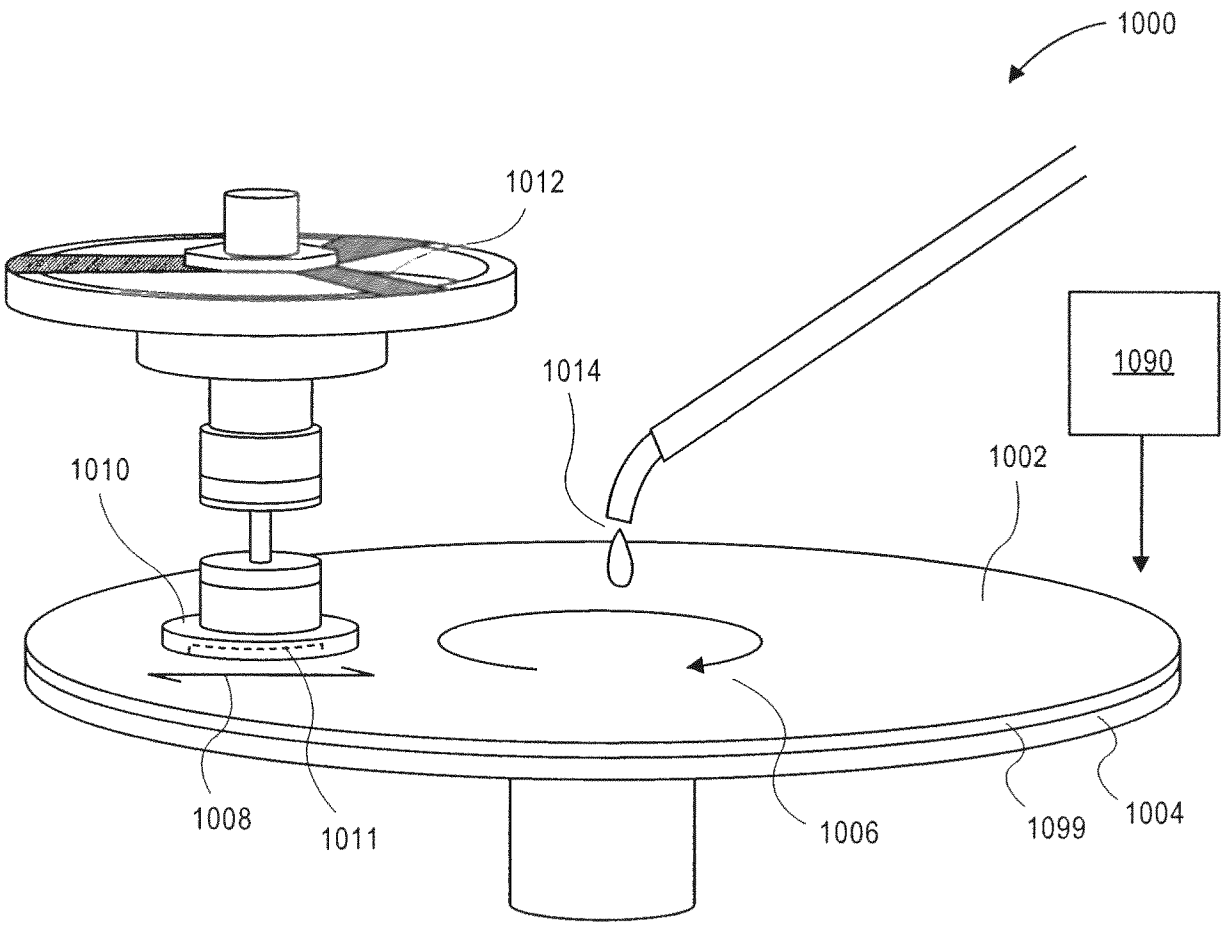
FIG. 10 illustrates an isometric side-on view of a polishing apparatus compatible with a polishing pad/subpad polishing pad stack, in accordance with an embodiment of the present invention.

Referring to FIG. 10, a polishing apparatus 1000 includes a platen 1004. The top surface 1002 of platen 1004 may be used to support a polishing pad/subpad polishing pad stack 1099. Platen 1004 may be configured to provide spindle rotation 1006. A sample carrier 1010 is used to hold, e.g., a semiconductor wafer 1011 in place during polishing of the semiconductor wafer with the polishing pad/subpad polishing pad stack 1099 and to provide slider oscillation 1008. Sample carrier 1010 is further supported by a suspension mechanism 1012. A slurry feed 1014 is included for providing slurry to a surface of the polishing pad/subpad polishing pad stack 1099 prior to and during polishing of the semiconductor wafer. A conditioning unit 1090 may also be included and, in one embodiment, includes a diamond tip for conditioning the polishing pad of the polishing pad/subpad polishing pad stack 1099 combination. In an embodiment, a relatively weaker adhesive coated adhesive layer on the subpad is used to mount the polishing pad/subpad polishing pad stack 1099 on the platen 1004. In an embodiment, a relatively stronger adhesive coated adhesive layer secures the subpad to the polishing pad.

Thus, coated compressive subpads for polishing pad stacks and methods of fabricating coated compressive subpads for polishing pad stacks have been disclosed.

What is claimed is:

1. A subpad for a polishing pad stack, the subpad comprising:

a compressive subpad material having a first surface and a second, opposite, surface;

a first pressure sensitive adhesive layer coated on the first surface of the compressive subpad material, and a first release liner disposed on the first pressure sensitive adhesive layer; and a second pressure sensitive adhesive layer coated on the second surface of the compressive subpad material, wherein the compressive subpad material is a compressive foam subpad material, and wherein the first and second surfaces of the compressive foam subpad material each have a surface energy approximately in the range of 30-40 dyne/cm$^2$, and the first pressure sensitive adhesive layer is in direct contact with at least 90% of the total surface area of the first surface of the compressive subpad material.

2. The subpad of claim 1, further comprising:

a second release liner disposed on the second pressure sensitive adhesive layer.

3. The subpad of claim 1, wherein the first pressure sensitive adhesive layer is a removable pressure sensitive adhesive layer, and wherein the second pressure sensitive adhesive layer is a permanent pressure sensitive adhesive layer.

4. The subpad of claim 3, wherein the permanent pressure sensitive adhesive layer is for coupling to a hack surface of a polishing pad, and wherein the removable pressure sensitive adhesive layer is for coupling the subpad to a platen of a chemical mechanical polishing apparatus.

5. The subpad of claim 1, wherein the second pressure sensitive adhesive layer has a peel strength of greater than approximately 4.5 pounds per inch at 25 degrees Celsius, and wherein the first pressure sensitive adhesive layer has a peel strength of less than approximately 4 pounds per inch at 25 degrees Celsius.

6. The subpad of claim 1, wherein the compressive subpad material is a compressive foam subpad material comprising a material selected from the group consisting of an ethylene vinyl acetate closed cell foam material, a polyethylene closed cell foam material, and a polyurethane mostly closed cell foam material.

7. The subpad of claim 1, wherein the compressive subpad material has a thickness approximately in the range of 10 mils to 40 mils.

8. The subpad of claim 1, wherein the second pressure sensitive adhesive layer comprises a first material selected from the group consisting of an acrylic material, a rubber, ethylene vinyl acetate, a silicone material, and a block co-polymer, and wherein the first pressure sensitive adhesive layer comprises a second material selected from the group consisting of an acrylic material, a rubber, ethylene vinyl acetate, a silicone material, and a block co-polymer.

9. The subpad of claim 1, wherein the first surface of the compressive subpad material has a surface roughness of at least 3 microns and has a total surface area, and the first pressure sensitive adhesive layer is in direct contact with at least 95% of the total surface area of the first surface of the compressive subpad material.

10. The subpad of claim 9, wherein the second surface of the compressive subpad material has a surface roughness of at least 3 microns and has a total surface area, and the second pressure sensitive adhesive layer is in direct contact with at least 90% of the total surface area of the second surface of the compressive subpad material.

* * * * *